US010984759B2

(12) United States Patent
Chun et al.

(10) Patent No.: US 10,984,759 B2
(45) Date of Patent: Apr. 20, 2021

(54) AFTERIMAGE COMPENSATOR AND METHOD FOR DRIVING DISPLAY DEVICE

(71) Applicant: SAMSUNG DISPLAY CO., LTD., Yongin-si (KR)

(72) Inventors: Byung Ki Chun, Yongin-si (KR); Young Wook Yoo, Yongin-si (KR); Jun Gyu Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 9 days.

(21) Appl. No.: 16/447,226

(22) Filed: Jun. 20, 2019

(65) Prior Publication Data

US 2020/0082796 A1 Mar. 12, 2020

(30) Foreign Application Priority Data

Sep. 12, 2018 (KR) ..... 10-2018-0109169

(51) Int. Cl.
*G09G 5/38* (2006.01)
*G09G 5/373* (2006.01)

(52) U.S. Cl.
CPC ..... *G09G 5/38* (2013.01); *G09G 5/373* (2013.01); *G09G 2320/0257* (2013.01); *G09G 2320/046* (2013.01)

(58) Field of Classification Search
CPC ..... G09G 2320/0257; G09G 2320/046; G09G 2360/16; G09G 5/373; G09G 5/38; G09G 3/007
See application file for complete search history.

(56) References Cited

U.S. PATENT DOCUMENTS

2016/0125787 A1* 5/2016 Pyeon ..... G09G 3/2055 345/691
2016/0322020 A1* 11/2016 Park ..... G09G 3/3696
2016/0329008 A1 11/2016 Chun et al.
2017/0024006 A1* 1/2017 Kwon ..... G09G 3/2003

FOREIGN PATENT DOCUMENTS

KR 10-2016-0132170 11/2016

* cited by examiner

*Primary Examiner* — Abbas I Abdulselam

(74) *Attorney, Agent, or Firm* — Lewis Roca Rothgerber Christie LLP

(57) ABSTRACT

An afterimage compensator includes: a global shifter configured to determine an upscaling area and a downscaling area of a display unit, that together correspond to a preset global shift path, to shift a main image of the display unit; a logo shifter configured to analyze image data corresponding to a logo image and a preset logo peripheral area surrounding the logo image, and configured to determine a logo upscaling area and a logo downscaling area that are each included in the logo peripheral area, the logo shifter being further configured to shift the logo image; and a scaler configured to combine the upscaling area, the downscaling area, the logo upscaling area, and the logo downscaling area and configured to scale image data corresponding to the combined scaling area.

20 Claims, 8 Drawing Sheets

AFTERIMAGE COMPENSATOR AND METHOD FOR DRIVING DISPLAY DEVICE

CROSS-REFERENCE TO RELATED APPLICATION

The present application claims priority to and the benefit of Korean patent application 10-2018-0109169 filed on Sep. 12, 2018, in the Korean Intellectual Property Office, the entire content of which is incorporated herein by reference.

BACKGROUND

1. Field

Embodiments of the present disclosure generally relate to a display device, and, for example, to an afterimage compensator and a method for driving a display device.

2. Description of the Related Art

In a display device such as an organic light emitting display (OLED) device, a liquid crystal display (LCD) device or a plasma display device, a pixel is degraded when driving time elapses, and as a result, an afterimage may occur. For example, when a logo, subtitle or the like, which is displayed with high luminance, is continuously displayed for a long time in a set or specific area of a display screen, degradation of a set or specific pixel is accelerated, and as a result, an afterimage may occur.

In order to solve this problem, a technique for moving and displaying the entire image on a display panel in a certain period has recently been used.

SUMMARY

Embodiments provide an afterimage compensator for performing a logo shift, in addition to a global shift.

Embodiments also provide a method for driving a display device including the afterimage compensator.

According to an aspect of an embodiment of the present disclosure, there is provided an afterimage compensator including: a global shifter configured to determine an upscaling area and a downscaling area of a display unit that together correspond to a preset global shift path, the global shifter being further configured to shift a main image of the display unit; a logo shifter configured to analyze image data corresponding to a logo image and a preset logo peripheral area surrounding the logo image, and configured to determine a logo upscaling area and a logo downscaling area that are each included in the logo peripheral area, the logo shifter being further configured to shift the logo image; and a scaler configured to combine the upscaling area, the downscaling area, the logo upscaling area, and the logo downscaling area, and configured to scale image data corresponding to the combined scaling area.

The logo image may be shifted correlatively to the shift of the main image.

The main image and the logo image may be shifted in different periods.

The logo shifter may include: a logo detector configured to determine the logo image and the logo peripheral area, based on image data; and a scaling area determiner configured to detect a contour line included in the logo image and the logo peripheral area, and configured to determine the logo upscaling area and the logo downscaling area by comparing the contour line and a preset threshold value.

The logo image may be shifted in a direction from the logo upscaling area to the logo downscaling area.

When the contour line is not detected in the logo peripheral area, the scaling area determiner may change the logo upscaling area and the logo downscaling area in a preset period.

When a horizontal sum of the contour line is smaller than a first threshold value (e.g., a first threshold value of the preset threshold value), each of the logo upscaling area and the logo downscaling area may be included in one of an upper logo peripheral area and a lower logo peripheral area of the logo image.

When a vertical sum of the contour line is smaller than a second threshold value (e.g., a second threshold value of the preset threshold value), each of the logo upscaling area and the logo downscaling area may be included in one of a left logo peripheral area and a right logo peripheral area of the logo image.

When the horizontal sum of the contour line is equal to or larger than the first threshold value and the vertical sum of the contour line is equal to or larger than the second threshold value, the scaling area determiner may not set the logo upscaling area and the logo downscaling area.

The logo image may be shifted based on the global shift path.

The main image may be shifted in a direction from the upscaling area to the downscaling area.

A scaling ratio according to the upscaling area and the downscaling area and a scaling ratio according to the logo upscaling area and the logo downscaling area may be equal to each other.

The scaling ratio according to the logo upscaling area and the logo downscaling area may be smaller than the scaling ratio according to the upscaling area and the downscaling area.

At least one selected from a shift amount and a shift direction of a shift path of the logo image may be different from that of the global shift path.

The upscaling area and the downscaling area may respectively correspond to preset pixel columns consecutive from an outermost pixel column of the display unit and preset pixel rows consecutive from an outermost pixel row of the display unit.

According to another aspect of an embodiment of the present disclosure, there is provided a method for driving a display device, the method including: detecting a logo image, based on image data; detecting a contour line included in a preset logo peripheral area surrounding the logo image; determining a logo upscaling area and a low downscaling area by comparing the contour line and a preset threshold value; determining an upscaling area and a downscaling area of a display unit that together correspond to a preset global shift path, to shift a main image of the display unit; combining the upscaling area, the downscaling area, the logo upscaling area, and the logo downscaling area to provide a combined scaling area, and scaling image data corresponding to the combined scaling area; and displaying an image obtained by shifting at least one selected from the logo image and the main image, based on the scaled image data.

In the determining of the logo upscaling area and the logo downscaling area, when a horizontal sum of the contour line is smaller than a first threshold value (e.g., a first threshold value of the preset threshold value), the logo upscaling area and the logo downscaling area may be determined such that each of the logo upscaling area and the logo downscaling area is included in one of an upper logo peripheral area and a lower logo peripheral area of the logo image.

In the determining of the logo upscaling area and the logo downscaling area, when a vertical sum of the contour line is smaller than a second threshold value (e.g., a second threshold value of the preset threshold value), the logo upscaling area and the logo downscaling area may be determined such that each of the logo upscaling area and the logo downscaling area is included in one of a left logo peripheral area and a right logo peripheral area of the logo image.

In the determining of the logo upscaling area and the logo downscaling area, when the horizontal sum of the contour line is equal to or larger than the first threshold value and the vertical sum of the contour line is equal to or larger than the second threshold value, the logo upscaling area and the logo downscaling area may not be set.

The logo image may be shifted based on the global shift path.

In the afterimage compensator, the display device having the same, and the method for the driving the display device according to the present disclosure, the entire screen can be shifted without cutoff of an image at an edge of the screen and/or non-output of the image, using a complementary image scaling technique. Further, the logo peripheral area is upscaled/downscaled, additionally to the global shift, so that the shift range of the logo image can be increased. Thus, stress of pixels, which is caused by the logo image, is dispersed over a larger area, and degradation of pixels and occurrence of an afterimage, which are caused by the logo image, can be considerably minimized or reduced.

BRIEF DESCRIPTION OF THE DRAWINGS

Example embodiments will now be described more fully hereinafter with reference to the accompanying drawings; however, the subject matter of the present disclosure may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
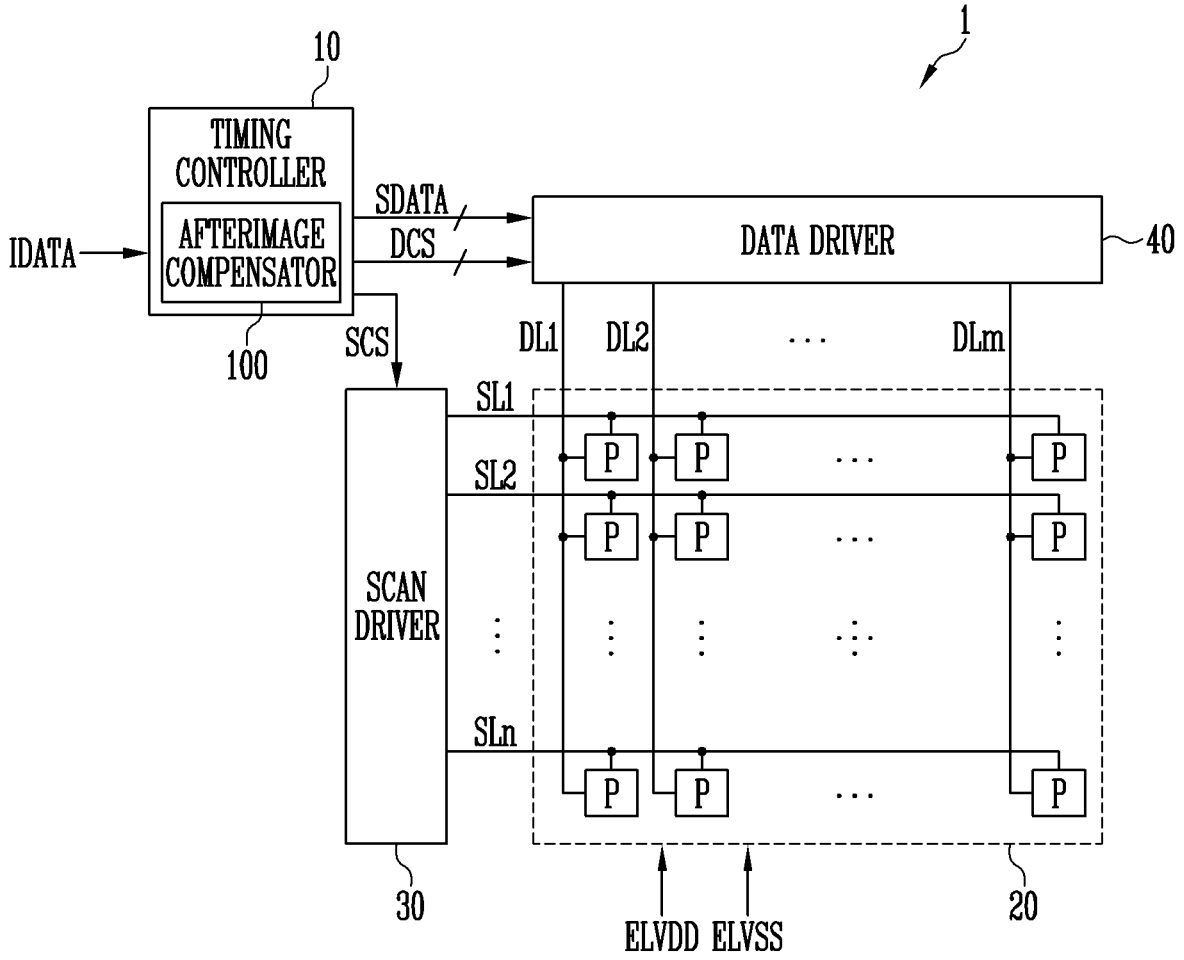
FIG. 1 is a block diagram illustrating a display device according to an embodiment of the present disclosure.

Hereinafter, exemplary embodiments of the present disclosure will be described in more detail with reference to the accompanying drawings. Throughout the drawings, the same reference numerals are given to the same elements, and redundant descriptions thereof will not be repeated.

FIG. 1 is a block diagram illustrating a display device according to an embodiment of the present disclosure.

Referring to FIG. 1, the display device 1 may include a timing controller 10, a display unit 20, a scan driver 30, a data driver 40, and an afterimage compensator 100. The display unit 20 is coupled between a first power source ELVDD and a second power source ELVSS.

In an embodiment, at least some components of the afterimage compensator 100 may be included in the timing controller 10 and/or the data driver 40.

In an embodiment, the display device 1 may be implemented as an organic light emitting display device including a plurality of organic light emitting devices. This is merely illustrative, however, and the display device 1 may be implemented as a liquid crystal display device, a plasma display device, a quantum dot display device, and/or the like.

The display unit 20 may include a plurality of pixels P. The display unit 20 may be coupled to the scan driver 30 through a plurality of scan lines SL1, SL2 to SLn, and be coupled to the data driver 40 through a plurality of data lines DL1, DL2 to DLm. The display unit 20 may include m (m is a positive integer) pixel columns respectively coupled to the data lines DL1, DL2 to DLm and n (n is a positive integer) pixel rows respectively coupled to the scan lines SL1, SL2 to SLn. The display unit 20 may display an image, based on input image data IDATA received from the outside or image data SDATA scaled by the afterimage compensator 100.

The display unit 20 may display a main image including actual image information (or the entire image) and a logo image that is a still image. For example, the logo image may include a logo of a broadcasting company, a subtitle, a data, a time, etc. Also, the logo image may be an area (or image) displayed with a high luminance (high grayscale) for a set or certain time or more.

The scan driver 30 may provide a scan signal to the display unit 20 through the plurality of scan lines SL1, SL2 to SLn. In an embodiment, each of the scan lines SL1, SL2 to SLn may be coupled to pixels P located on a corresponding pixel row.

The data driver 40 may provide a data signal to the display unit 20 through the plurality of data lines DL1, DL2 to DLm according to the scan signal. In an embodiment, the data driver 40 may generate a data signal corresponding to the scaled image data SDATA, and provide the data signal to the display unit 20. In an embodiment, each of the data lines DL1, DL2 to DLm may be coupled to pixels P located on a corresponding pixel column of the display unit 20.

The timing controller 10 may generate a plurality of control signals SCS and DCS and provide the generated control signals to the scan driver 30 and the data driver 40, to control the scan driver 30 and the data driver 40. The timing controller 10 may receive an input control signal and input image data IDATA from an image source such as an external graphic device. The input control signal may include a main clock signal, a vertical synchronization signal, a horizontal synchronization signal, and a data enable signal. The timing controller 10 may generate image data (designated as DATA in FIG. 2) suitable for an operating condition of the display unit 20, based on the input image data IDATA, and provide the generated image data to the data driver 40. In some embodiments, the timing controller 10 may generate a first control signal SCS configured to control a driving timing of the scan driver 30 and a second control signal DCS configured to control a driving timing of the data driver 40, based on the input control signal, and provide the first control signal SCS and the second control signal DCS, respectively, to the scan driver 30 and the data driver 40. In an embodiment, the afterimage compensator 100 may be included in the timing controller 10. In another embodiment, the afterimage compensator 100 may be coupled to the timing controller 10.

An image may be shifted and displayed on the display unit 20 so as to prevent or reduce occurrence of an afterimage, which is caused by a still image such as a logo being displayed through the same pixel for a long time.

The afterimage compensator 100 may generate scaled image data SDATA for shifting the logo image and the main image by upscaling a portion of the image data DATA, corresponding to a partial area (e.g., an upscaling area), and downscaling a portion of the image data DATA, corresponding to another partial area (e.g., a downscaling area).

In an embodiment, the afterimage compensator 100 may include a global shifter configured to determine a shift direction and a shift amount of the main image, a logo shifter configured to determine a shift direction and a shift amount of the logo image, separately from the main image, and a scaler configured to perform scaling on the image data by combining output values of the global shifter and the logo shifter.

Figure 2:
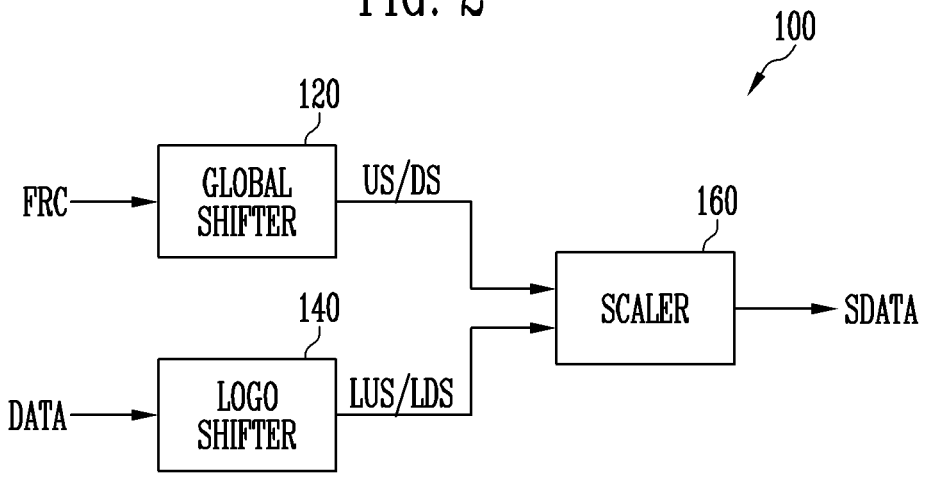
FIG. 2 is a block diagram illustrating an afterimage compensator according to an embodiment of the present disclosure.

FIG. 2 is a block diagram illustrating an afterimage compensator according to an embodiment of the present disclosure.

Referring to FIGS. 1-2, the afterimage compensator 100 may include a global shifter 120, a logo shifter 140, and a scaler 160.

The afterimage compensator 100 may implement an image shift effect with respect to a set or predetermined area by upscaling image data corresponding to a partial area of the display unit 20 and downscaling image data corresponding to another partial area of the display unit 20 at a ratio equal to the upscaling ratio.

In a comparative afterimage compensation technique, the entire image is moved and displayed in a set or certain period, and the same data is prevented from being output in a set or specific pixel for a long time, thereby minimizing or reducing degradation of the set or specific pixel. However, when the entire (or substantially the entire) image is moved in a set or certain period, a portion of the original image is cut off from a screen, and the image is not output at an edge of the display unit 20, which is opposite to the portion of the original image. As a result, the image is distorted.

The global shifter 120 may determine an upscaling area US and a downscaling area DS of the display unit 20, which correspond to a preset shift path to shift a main image of the display unit 20. The upscaling area US and the downscaling area DS may be set in a preset area of the display unit 20. For example, each of the upscaling area US and the downscaling area DS may include set or predetermined pixel rows and/or set or predetermined pixel columns, which are consecutive from an edge (an outermost pixel row and an outermost pixel column) of the display unit 20. Image data corresponding to the upscaling area US may be upscaled, and image data corresponding to the downscaling area DS may be downscaled. The main image may be defined as an image that does not overlap with the upscaling area and the downscaling area.

In an example, the upscaling area US may correspond to a plurality of pixel columns at a left edge of the display unit 20, and correspond to a plurality of pixel columns at a right edge of the display unit 20. The main image may be shifted in a direction from the upscaling area US to the downscaling area DS.

In an embodiment, the global shifter 120 may change a shift direction and a shift amount of the main image, based on a frame count FRC. An embodiment of the frame count FRC includes a number of frames in which an image is displayed, and the number of frames may correspond to an image display time.

The shift direction and shift amount of an image may be determined according to a preset or pre-stored shift path. For example, the global shifter 120 may change the shift path at an interval of about 4 seconds, but the present disclosure is not limited thereto.

The global shifter 120 may provide the scaler 160 with information of the determined upscaling area US and the determined downscaling area DS.

The global shifter 120 implements an image shift through image scaling, so that screen distortion such as cutoff of an image at an edge of the screen or non-output of the image can be eliminated or reduced. When a logo image overlaps with the upscaling area or the downscaling area, however, an image shift effect with respect to the logo image may be reduced.

Therefore, the logo shifter 140 may be added to maximally (or substantially maximally) disperse stress of the logo image and maximize or increase the image shift.

The logo shifter 140 may analyze image data DATA corresponding to a logo image and a preset logo peripheral area surrounding the logo image. The logo shifter 140 may determine a logo upscaling area LUS and a logo downscaling area LDS, based on the result of the analysis to shift the logo image. The logo shifter 140 may provide the scaler 160 with the determined logo upscaling area LUS and the determined logo downscaling area LDS.

The logo upscaling area LUS and the logo downscaling area LDS do not overlap with the logo image, and may be included in the logo peripheral area. Also, the logo upscaling area LUS and the logo downscaling area LDS is not out of the logo peripheral area. Image data corresponding to the logo upscaling area LUS may be upscaled, and image data corresponding to the logo downscaling area LDS may be downscaled.

In an embodiment, the logo image may be shifted in a direction from the logo upscaling area LUS and the logo downscaling area LDS.

In an embodiment, the logo shifter 140 may determine the logo upscaling area LUS and the logo downscaling area LDS according to a preset logo shift path. Therefore, the logo image may be shifted separately from the main image. For example, the shift path along which the main image is shifted and the logo shift path may be set to be different from each other.

In addition, the main image and the logo image may be shifted at different periods. For example, the shift path of the main image may be changed at an interval of 4 seconds, and the shift path of the logo image may be changed at an interval of 3 seconds, but the present disclosure is not limited thereto.

In an embodiment, the logo shifter 140 may determine whether a logo shift has been performed by detecting a contour line included in the logo peripheral area. For example, the logo shifter 140 may compare the contour line and a preset threshold value, and determine whether the logo shift has been performed and a logo shift direction according to the extending direction of the contour line.

An example configuration and operation of the logo shifter 140 will be described with reference to FIGS. 4-6B.

The scaler 160 may determine net scaling areas by combining the upscaling area US, the downscaling area DS, the logo upscaling area LUS, and/or the logo downscaling area LDS. For example, the upscaling area US and the logo upscaling area LUS may overlap with each other, and the downscaling area DS and the logo downscaling area LDS may overlap with each other. Then, in that case, a shift amount of the logo image may be larger than that caused by the preset logo shift path. In some embodiments, the downscaling area DS and the logo upscaling area LUS may overlap with each other, or the upscaling area US and the logo downscaling area LDS may overlap with each other. Then, in those cases, a shift amount of the logo image may be smaller than that caused by the preset logo shift path.

In some embodiments, the shift of the main image except the logo image and the logo peripheral area is not influenced by the logo shift.

The scaler 160 may scale image data corresponding to the combined scaling area (e.g., the net scaling area). Accordingly, the logo image can be shifted correlatively to the shift of the main image. The scaler 160 may perform upscaling on image data on which the upscaling is to be performed among image data corresponding to the net scaling areas, and perform downscaling on image data on which the downscaling is to be performed among the image data corresponding to the net scaling areas. The upscaling/downscaling may be performed through any suitable hardware and/or software scaler configurations available in the art.

As described above, the afterimage compensator 100 according to the embodiment of the present disclosure can shift the entire screen (e.g., the entire image) without cutoff of an image at an edge of the screen and/or non-output of the image, using a complementary image scaling technique. Further, the logo peripheral area is upscaled/downscaled, additionally to a global shift, so that the shift range of the logo image can be increased.

Figure 3:
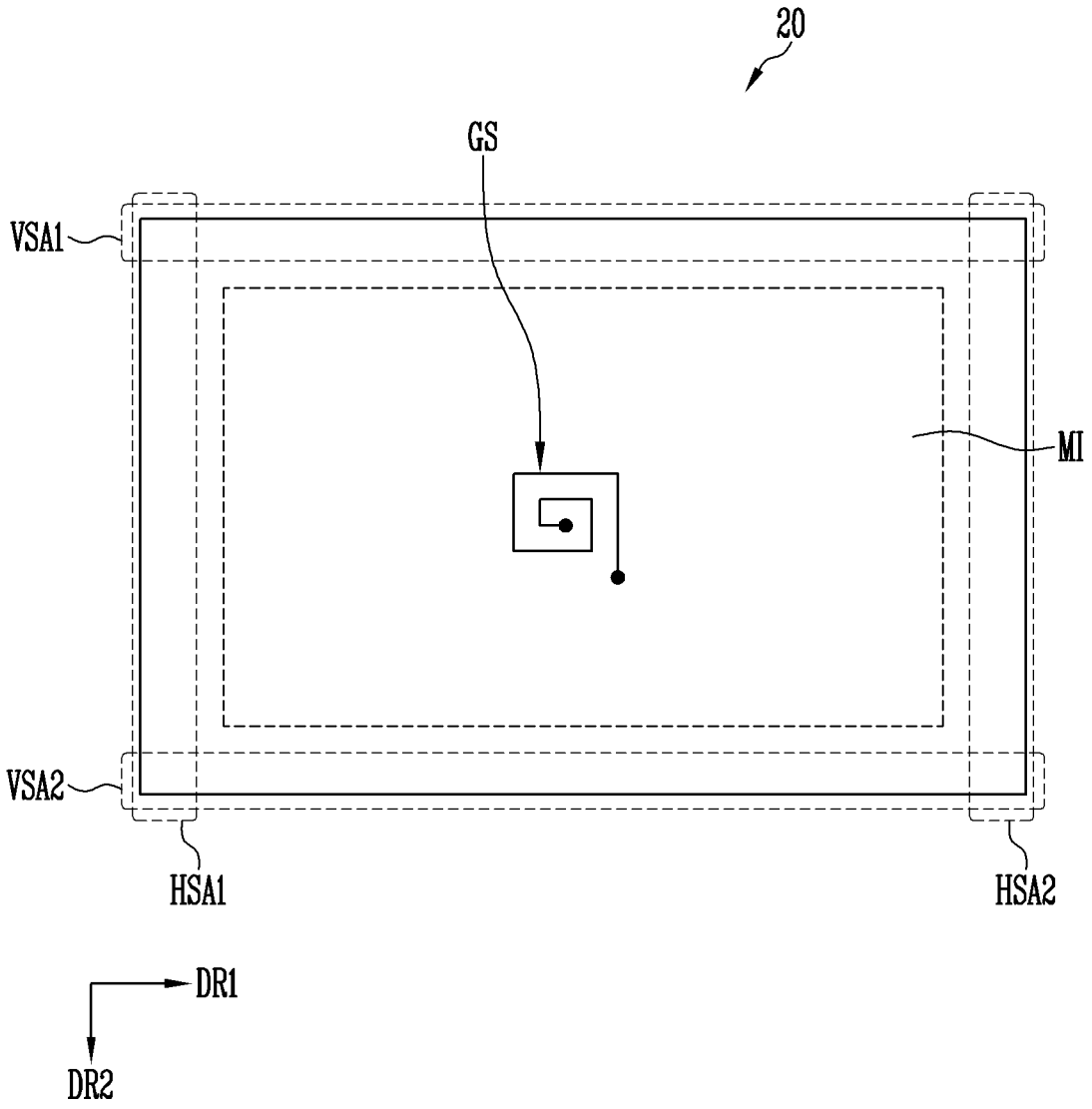
FIG. 3 is a diagram illustrating an example of an operation of a global shifter included in the afterimage compensator of FIG. 2.

FIG. 3 is a diagram illustrating an example of an operation of the global shifter included in the afterimage compensator of FIG. 2.

Referring to FIGS. 1-3, a main image MI may be shifted along a preset global shift path GS by the global shifter 120.

The display unit 20 may include four scaling areas HSA1, HSA2, VSA1, and VSA2 at an edge thereof. Image data corresponding to pixel columns or pixel rows, which are included in the scaling areas HSA1, HSA2, VSA1, and VSA2, may be upscaled or downscaled.

A first horizontal scaling area HSA1 and a second horizontal scaling area HSA2 may have a complementary relationship. For example, when at least a portion of the first horizontal scaling area HSA1 is determined as the upscaling area US (or downscaling area DS), at least a portion of the second horizontal scaling area HSA2 may be determined as the downscaling area DS (or upscaling area US). The first horizontal scaling area HSA1 and the second horizontal scaling area HSA2 may correspond to a plurality of pixel columns.

Similarly, when at least a portion of a first vertical scaling area VSA1 is determined as the upscaling area US (or downscaling area DS), at least a portion of a second vertical scaling area VSA2 may be determined as the downscaling area DS (or upscaling area US). The first vertical scaling area VSA1 and the second vertical scaling area VSA2 may correspond to a plurality of pixel rows.

In an embodiment, the main image MI may be shifted in a direction from the upscaling area US to the downscaling area DS. For example, when the first horizontal scaling area HSA1 is the upscaling area US and the second horizontal scaling area HSA2 is the downscaling area DS, the main image MI may be shifted in a first direction DR1, e.g., to a right side.

A scaling ratio may be determined as a preset value. In an embodiment, a one-pixel shift of the main image IM may be set based on 32 consecutive (e.g., sequentially arranged) pixel rows or 32 consecutive (e.g., sequentially arranged) pixel columns. For example, in FIG. 3, when the main image MI is shifted to the right side, 33 pixel columns that are included in the first horizontal scaling area HSA1 and are consecutive (e.g., sequentially arranged) from the outermost edge of the first horizontal scaling area HSA1 may be determined as the upscaling area US, and 31 pixel columns that are included in the second horizontal scaling area HSA2 and are consecutive (e.g., sequentially arranged) from the outermost edge of the second horizontal scaling area HSA2 may be determined as the downscaling area DS.

The 33 pixel columns of the upscaling area US display an image corresponding to the existing 32 pixel columns of the first horizontal scaling area HSA1. Therefore, image data corresponding to the upscaling area US may be upscaled at a ratio of 33:32. The 31 pixel columns of the downscaling area DS display an image corresponding to the existing 32 pixel columns of the second horizontal scaling area HSA2. Therefore, image data corresponding to the downscaling area US may be downscaled at a ratio of 31:32.

Accordingly, the main image can be one-pixel-shifted to the right side without cutoff of an image at an edge of the screen and/or non-output of the image.

Similarly, when the upscaling area US is included in the second horizontal scaling area HSA2 and the downscaling area DS is included in the first horizontal scaling area HSA1, the main image MI may be shifted to a left side. When the upscaling area US is included in the first vertical scaling area VSA1 and the downscaling area DS is included in the second vertical scaling area VSA2, the main image MI may be shifted in a second direction DR2 (e.g., to a lower side). When the upscaling area US is included in the first vertical scaling area VSA1 and the first horizontal scaling area HSA1, the main image MI may be shifted in a diagonal direction.

A shift (e.g., a global shift) of the main image MI may be periodically changed along a shift path (e.g., the global shift path GS). For example, as shown in FIG. 3, the main image MI may be shifted in a sequence of one pixel to the left side 4 one pixel to an upper side 4 two pixels to the right side 4 two pixels to the lower side. Again, the main image MI may be shifted in the reverse sequence of the above-described sequence, and periodically reciprocate along the global shift path GS. However, this is merely illustrative, and the global shift path GS is not limited thereto.

In addition, maximum sizes of the vertical and horizontal scaling areas VSA1, VSA2, HSA1, and HSA2 may be determined according to the global shift path GS. When the maximum shift amount of a pixel is set to four pixels, the vertical and horizontal scaling areas VSA1, VSA2, HSA1, and HSA2 may include a range of 132 pixel rows or 132 pixel columns.

In an embodiment, sizes of the upscaling area US and the downscaling area DS may be determined according to a shift amount (e.g., a global shift amount) of the main image MI. When an image is moved by four pixels, an image corresponding to the existing 128 pixels may be expanded to that corresponding to 132 pixels to be displayed in the upscaling area US, and image data corresponding to the upscaling area US may be upscaled at a ratio of 132:128. In addition, an image corresponding to the existing 128 pixels may be reduced to that corresponding to 124 pixels to be displayed in the downscaling area DS, and image data corresponding to the downscaling area DS may be downscaled. However, this is merely illustrative, and the scaling ratio is not limited thereto. The scaling ratio may be set such that image distortion caused by image scaling is not viewed.

Figure 4:
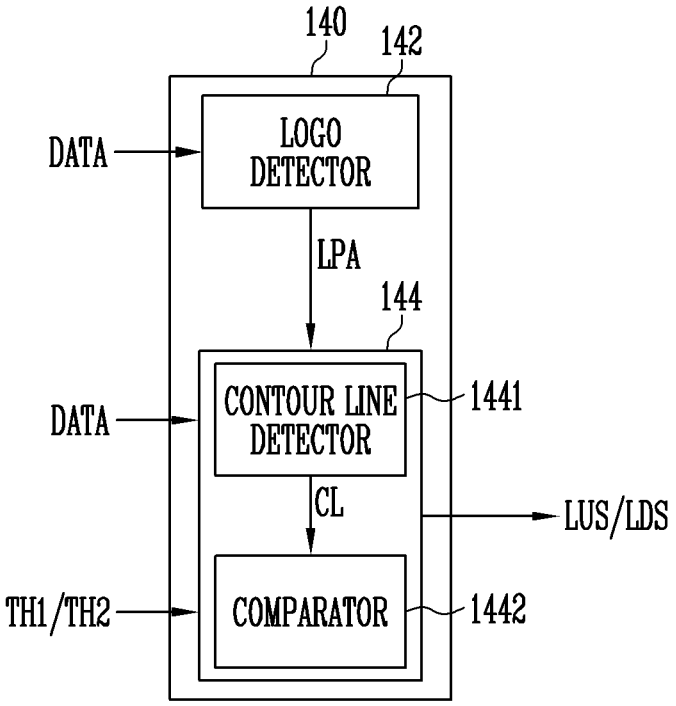
FIG. 4 is a block diagram illustrating an example of a logo shifter included in the afterimage compensator of FIG. 2.
Figure 5A:
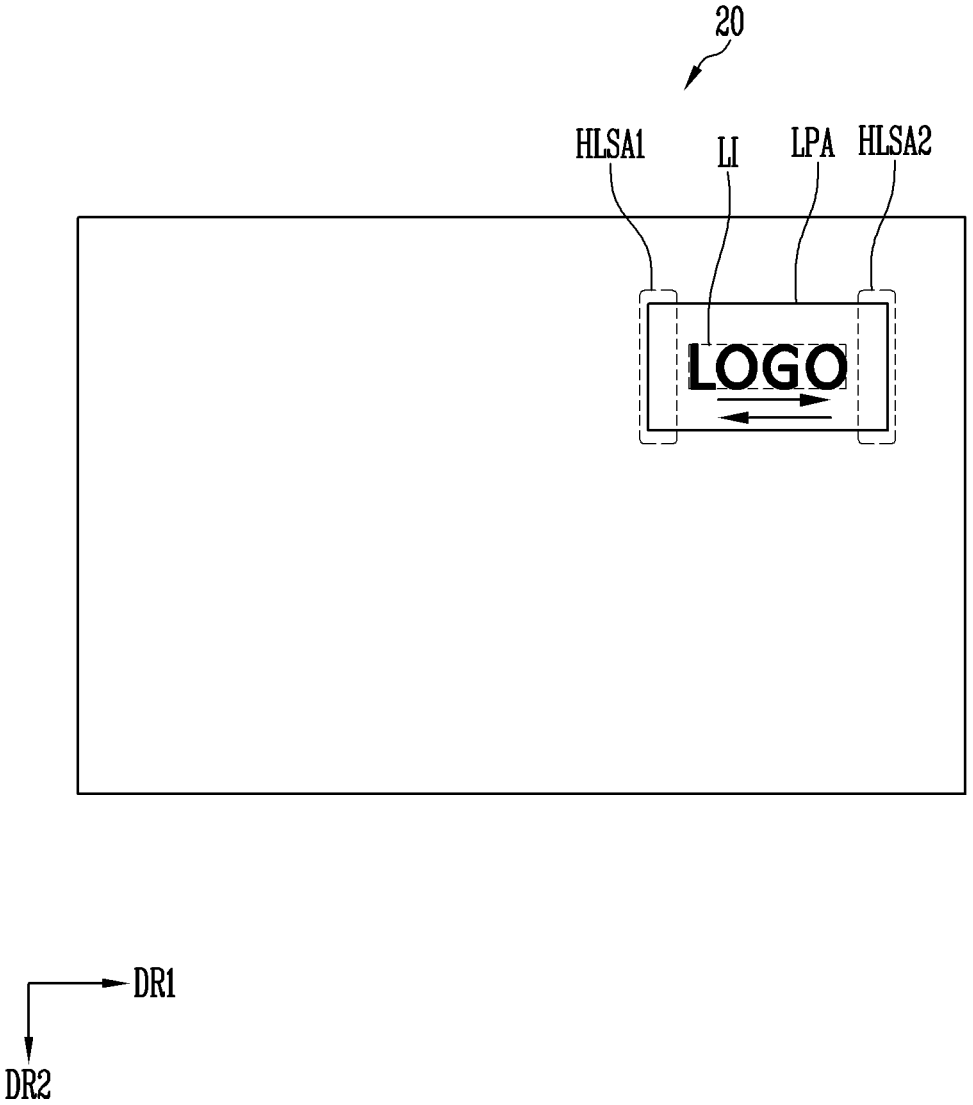
FIGS. 5A-5B are diagrams illustrating examples of an operation of the logo shifter of FIG. 4.
Figure 5B:
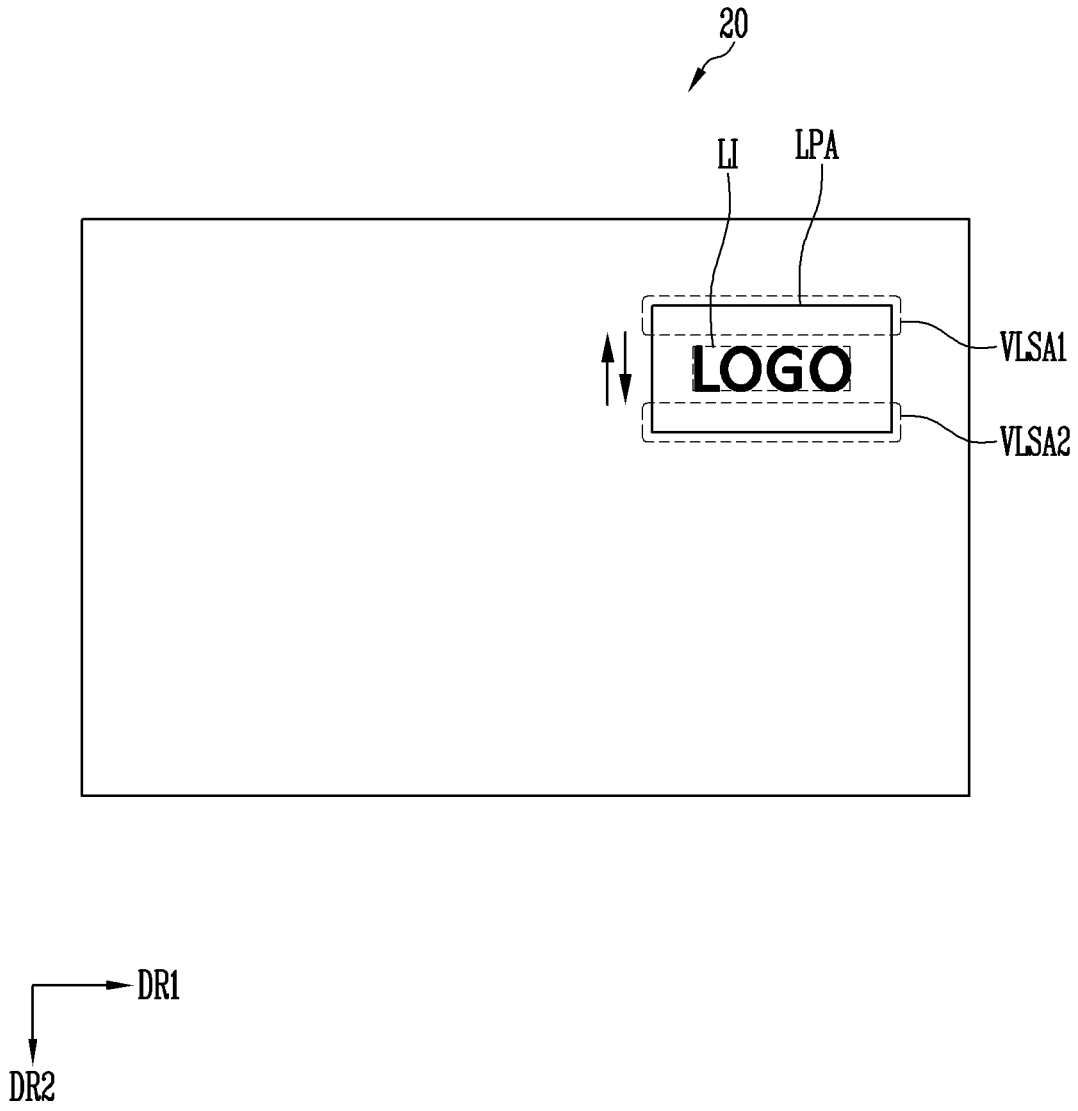

FIG. 4 is a block diagram illustrating an example of the logo shifter included in the afterimage compensator of FIG. 2. FIGS. 5A-5B are diagrams illustrating examples of an operation of the logo shifter of FIG. 4.

Referring to FIGS. 2-5B, the logo shifter 140 may include a logo detector 142 and a scaling area determiner 144.

The logo detector 142 may determine a logo image LI (shown in FIGS. 5A-5B) and a logo peripheral area LPA (shown in FIGS. 5A-5B), based on image data DATA. In an embodiment, the logo detector 142 may be implemented with any suitable Artificial Intelligence (AI) program. For example, a logo of each broadcasting company, time information, date information, etc., included in the image data, may be detected as the logo image LI. However, this is merely illustrative, and the logo detector 142 is not limited thereto. For example, the logo detector 142 may detect a still image with a high luminance, which is displayed for a preset time or more, using accumulation of the image data DATA.

The logo peripheral area LPA may be a scaling area surrounding the logo image LI. The logo peripheral area LPA may be determined as a scaling area range corresponding to a preset maximum shift amount of the logo image LI. For example, when the maximum shift amount corresponds to two pixels, and scaling (or image shift) is defined for every 32 pixels, the logo peripheral area LPA may include 66 pixel rows and 66 pixel columns, which surround the top, bottom, left, and right of the logo image LI.

As shown in FIGS. 5A-5B, the log peripheral area LPA may include a first horizontal logo peripheral areas HLSA1 and a second horizontal logo peripheral area HLSA2, and a first vertical logo peripheral areas VLSA1 and a second vertical logo peripheral area VLSA2. Image data corresponding to at least a portion of the first horizontal logo peripheral area HLSA1 and the second horizontal logo peripheral area HLSA2, and the first vertical logo peripheral area VLSA1 and the second vertical logo peripheral area VLSA2 may be upscaled or downscaled. Consequently, there can be obtained an effect that the logo image LI is shifted by scaling of a partial image corresponding to the logo peripheral area LPA.

The logo image LI may be shifted in a direction from the logo upscaling area LUS to the logo downscaling area LDS.

The scaling area determiner 144 may detect a contour line CL included in the logo image LI and/or the logo peripheral area LPA, and determine the logo upscaling area LUS and the logo downscaling area LDS by comparing the contour line CL and the preset threshold value (e.g., a first threshold value TH1 and a second threshold value TH2). In an embodiment, the scaling area determiner 144 may include a contour line detector 1441 configured to detect the contour line CL and a comparator 1442 configured to compare the contour line CL and the threshold values.

The contour line CL may include boundary portions at which grayscales of an image are rapidly changed. For example, when a contour line having a preset grayscale difference from surroundings occupies a certain portion or more in a logo peripheral area, distortion of the contour line and a peripheral image may be viewed due to image scaling on the logo peripheral area. Therefore, the logo upscaling area LUS and the logo downscaling area LDS may be determined when the contour line detected in the logo peripheral area is smaller than a preset threshold value.

The contour line CL may be detected using any suitable types (or kinds) of contour line detection filters or algorithms generally available in the art. For example, the contour line may be detected using a Sobel mask method.

As shown in FIG. 5A, each of the logo upscaling area LUS and the logo downscaling area LDS may be included in one of the left logo peripheral area HLSA1 and the right logo peripheral area HLSA2. For example, the logo upscaling area LUS may be included in the left logo peripheral area HLSA1 and the logo downscaling area LDS may be included in the right logo peripheral area HLSA2. In some embodiments, the logo upscaling area LUS may be included in the right logo peripheral area HLSA2 and the logo downscaling area LDS may be included in the left logo peripheral area HLSA1. The logo image LI may be shifted in left direction or the right direction.

In an embodiment, when a vertical sum of the contour line CL is smaller than a second threshold value TH2, the logo image LI may be shifted in the left direction and the right direction. The vertical sum of the contour line CL may be a length of the contour line CL in a second direction DR2 (e.g., a vertical direction) or a total grayscale sum of the contour line CL in the second direction DR2. For example, when the contour line CL in the vertical direction is equal to or larger than the second threshold value TH2, the shape of the contour line CL may be distorted due to a shift of the logo image LI in a horizontal direction. Therefore, when the vertical sum of the contour line CL is smaller than the second threshold value TH2, the logo upscaling area LUS and the logo downscaling area LDS may be respectively included in the left logo peripheral area HLSA1 (or the right logo peripheral area HLSA2) and the right logo peripheral area HLSA2 (or the left logo peripheral area HLSA1).

As shown in FIG. 5B, each of the logo upscaling area LUS and the logo downscaling area LDS may be included in one of the upper logo peripheral area VLSA1 and the lower logo peripheral area VLSA2. For example, the logo upscaling area LUS may be included in the upper logo peripheral area VLSA1 and the logo downscaling area LDS may be included in the lower logo peripheral area VLSA2. In some embodiments, the logo upscaling area LUS may be included in the lower logo peripheral area VLSA2 and the logo downscaling area LDS may be included in the upper logo peripheral area VLSA1. The logo image LI may be shifted in an upper direction or a lower direction.

In an embodiment, when a horizontal sum of the contour line CL is smaller than a first threshold value TH1, the logo image LI may be shifted in the upper direction or the lower direction. The horizontal sum of the contour line CL may be a length of the contour line CL in a first direction DR1 (e.g., the horizontal direction) or a total grayscale sum of the contour line CL in the first direction DR1. For example, when the contour line CL in the horizontal direction is equal to or larger than the first threshold value TH1, the shape of the contour line CL may be distorted due to a shift of the logo image LI in the vertical direction. Therefore, when the horizontal sum of the contour line CL is smaller than the first threshold value TH1, each of the logo upscaling area LUS and the logo downscaling area LDS may be included in one of the upper logo peripheral area VLSA1 and the lower logo peripheral area VLSA2.

In an embodiment, the logo image LI may be shifted by combining the operations of FIGS. 5A-5B. For example, when the horizontal sum of the contour line CL is smaller than the first threshold value TH1 and the vertical sum of the contour line CL is smaller than the second threshold value TH2, the logo image LI may be shifted in a diagonal direction. However, this is merely illustrative, and the present disclosure is not limited thereto. For example, the logo image LI may be shifted sequentially in the horizontal and vertical directions.

In an embodiment, when any contour line is not detected in the logo peripheral area LPA, the scaling area determiner 144 may change the logo upscaling area LUS and the logo downscaling area LDS in a preset period. For example, the logo image LI may be shifted along a preset logo shift path. The logo shift path may be set different from the shift path (global shift path) of the main image.

In an embodiment, a first scaling ratio according to the upscaling area US and the downscaling area DS and a second scaling ratio according to the logo upscaling area LUS and the logo downscaling area LDS may be equal to each other. For example, each of the first scaling ratio and the second scaling ratio may be a ratio at which the main image is one-pixel-shifted per 32 pixels.

In an embodiment, the second scaling ratio according to the logo upscaling area LUS and the logo downscaling area LDS may be smaller than the first scaling ratio according to the upscaling area US and the downscaling area DS. For example, the first scaling ratio may be a ratio at which the main image is one-pixel-shifted per 32 pixels, and the second scaling ratio may be a ratio at which the main image is one-pixel-shifted per 16 pixels.

As described above, in the afterimage compensator 100 and the display device 1 having the same according to the embodiment of the present disclosure, partial image scaling for a logo shift can be performed, in addition to a global shift. Thus, shift directions and shift amounts of the main image MI and the logo image LI can be different from each other.

Figure 6A:
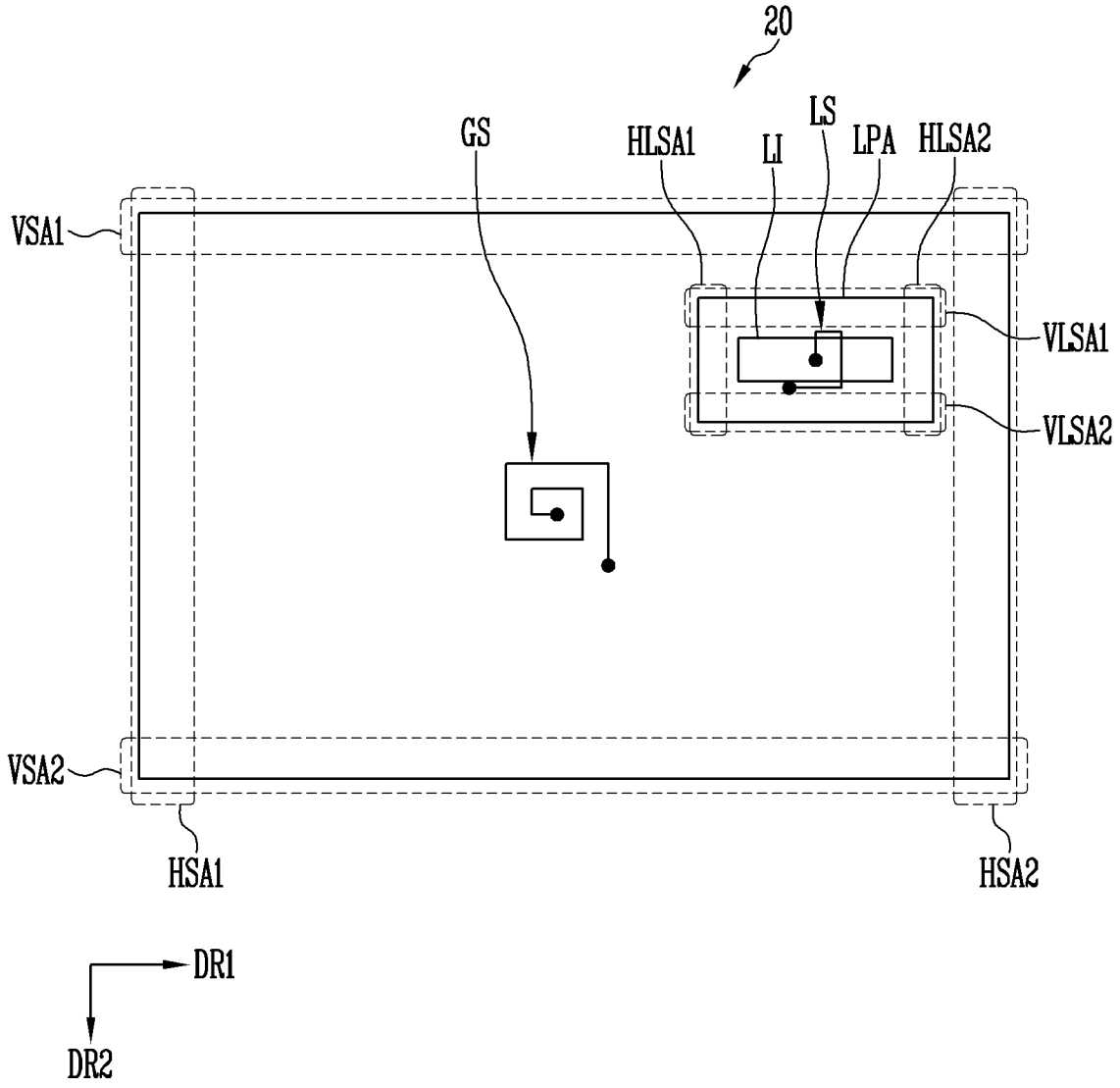
FIGS. 6A-6B are diagrams illustrating examples of an operation of the afterimage compensator of FIG. 2.
Figure 6B:
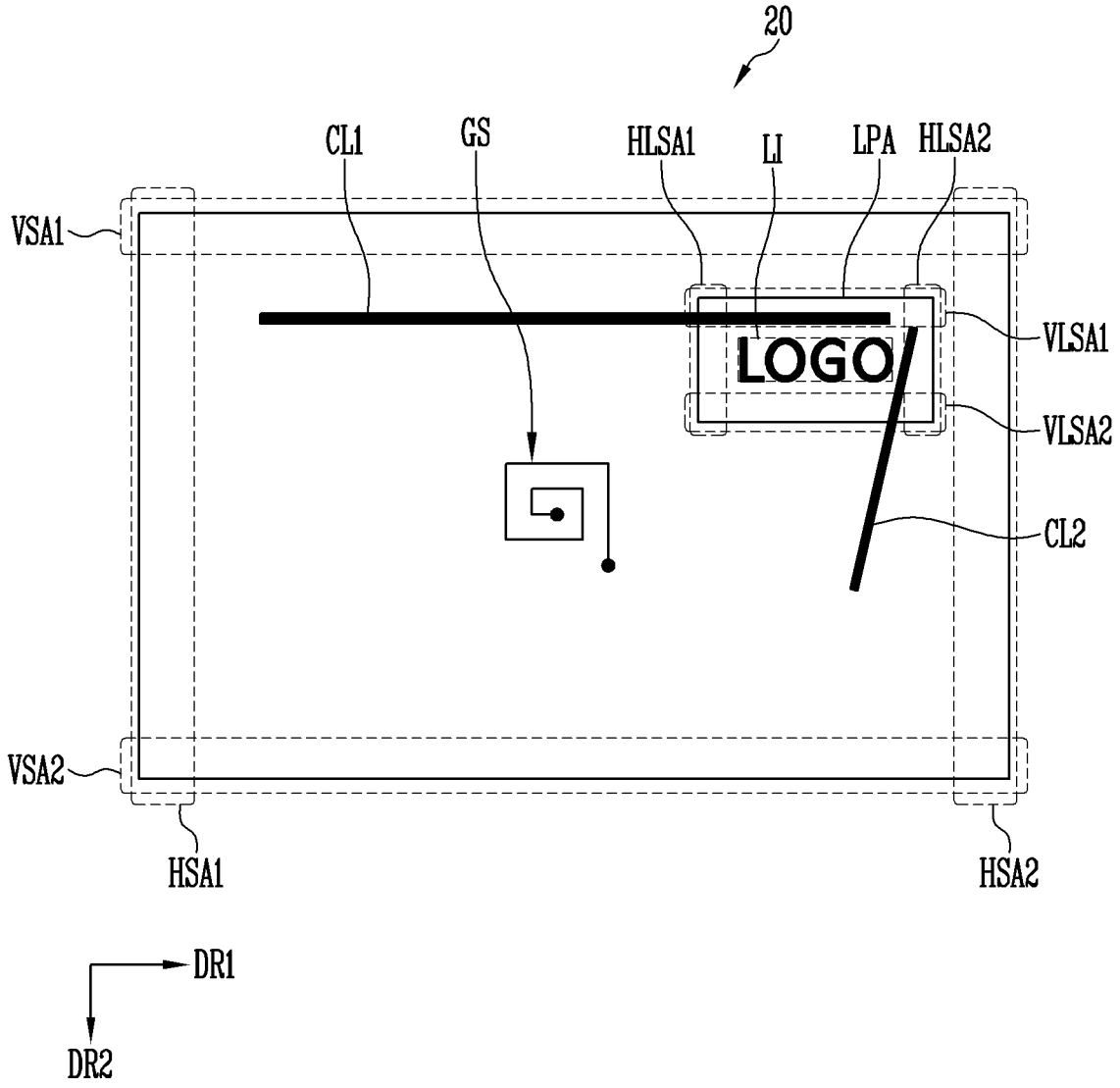

FIGS. 6A-6B are diagrams illustrating examples of an operation of the afterimage compensator of FIG. 2.

Referring to FIGS. 2-6B, the afterimage compensator 100 may perform a global shift for shifting the main image MI and a logo shift for shifting the logo image LI.

As shown in FIG. 6A, the global shift path GS and a logo shift path LS may be set to be different from each other. In an embodiment, at least one selected from a shift direction and a shift amount of the logo shift path LS may be different from that of the global shift path GS.

In an embodiment, the second scaling ratio according to the logo upscaling area LUS and the logo downscaling area LDS may be smaller than the first scaling ratio according to the upscaling area US and the downscaling area DS.

In some embodiments, at least a portion of the logo image LI may overlap with the upscaling area US or the downscaling area DS according to an image. Image scaling is performed on the logo image LI, and a shift amount of the logo image LI is smaller than that of the main image MI. In order to solve this problem, image scaling may be additionally performed on the logo peripheral area LPA. Therefore, the shift amount of the logo image LI may increase.

The scaler 160 may determine net scaling areas by combining the upscaling area US, the downscaling area DS, the logo upscaling area LUS, and the logo downscaling area LDS. The scaler 160 may perform the global shift and the logo shift by applying upscaling or downscaling to image data corresponding to each of the net scaling areas.

In an embodiment, when the horizontal sum of the contour line CL is equal to or larger than the first threshold value TH1 and the vertical sum of the contour line CL is equal to or larger than the second threshold value TH2, the scaling area determiner 144 does not set the logo upscaling area LUS and the logo downscaling area LDS. For example, as shown in FIG. 6B, a first contour line CL1 and a second contour line CL2 may be detected in the logo peripheral area LPA.

A horizontal sum of the first contour line CL1 may be larger than the first threshold value TH1. Therefore, the logo upscaling area LUS and the logo downscaling area LDS are not formed in the upper logo peripheral area VLSA1 and the lower logo peripheral area VLSA2. In addition, a vertical sum of the second contour line CL2 may be larger than the second threshold value TH2. Therefore, the logo upscaling area LUS and the logo downscaling area LDS are not formed in the left logo peripheral area HLSA1 and the right logo peripheral area HLSA2.

Accordingly, additional image scaling is not performed in the logo peripheral area LPA, and the logo image LI may be shifted based on the global shift path GS. For example, the logo image LI may be shifted according to image scaling of the upscaling and downscaling areas US and DS determined by the global shifter 120. When the logo image LI does not overlap with the upscaling and downscaling areas US and DS, the logo image LI and the main image MI may be equally shifted. When at least a portion of the logo image LI overlaps with the upscaling and downscaling areas US and DS, the logo image LI may be shifted less than the main image MI.

As described above, in the afterimage compensator 100 according to the embodiment of the present disclosure, the entire screen can be shifted without cutoff of an image at an edge of the screen and/or non-output of the image, using a complementary image scaling technique. Further, the logo peripheral area LPA is upscaled/downscaled, in addition to the global shift, such that the shift range of the logo image LI can be increased. Thus, stress of pixels, which is caused by the logo image LI, is dispersed over a larger area, and degradation of pixels and occurrence of an afterimage, which are caused by the logo image LI, can be considerably minimized or reduced.

Figure 7:
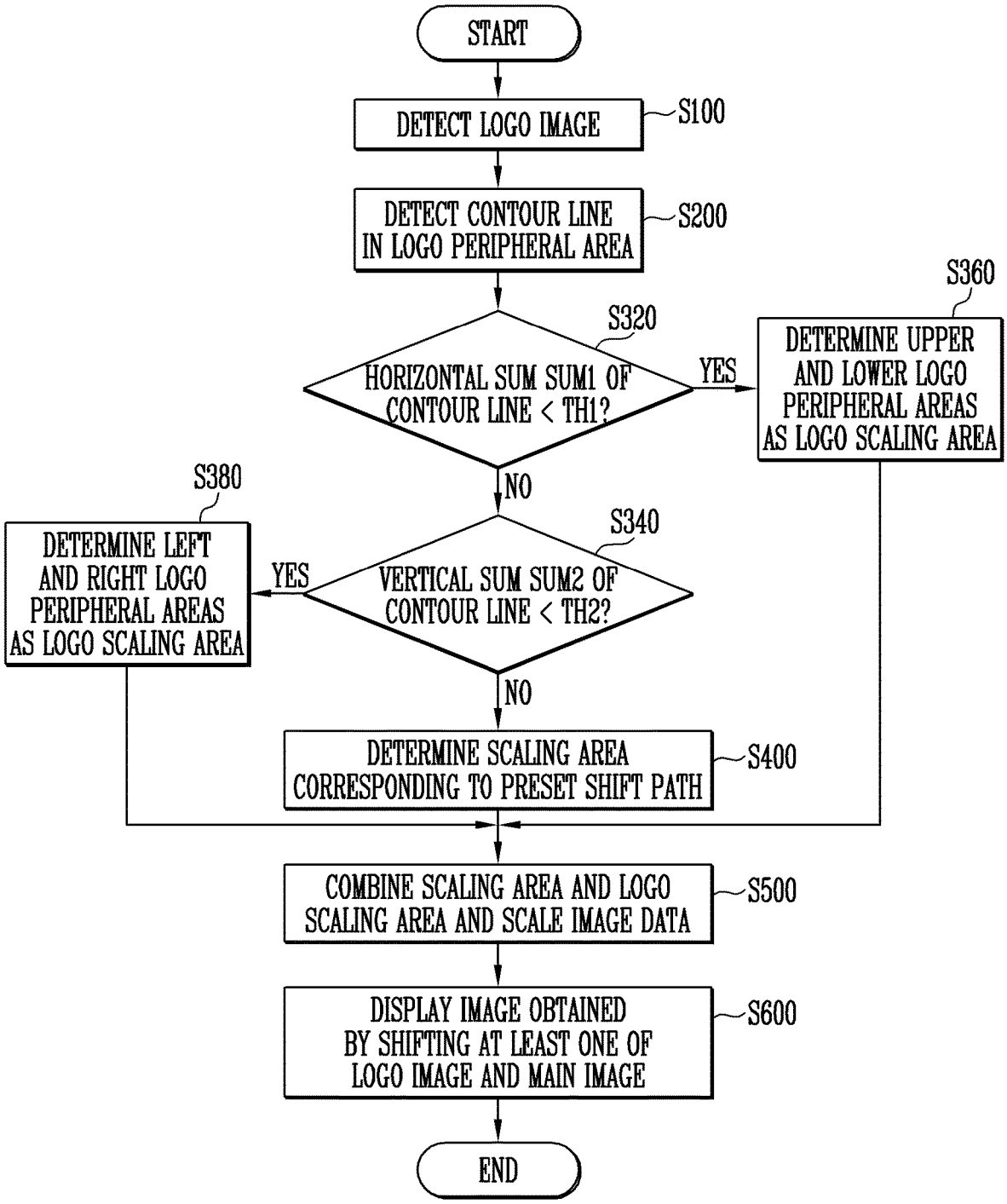
FIG. 7 is a flowchart illustrating a method for driving the display device according to an embodiment of the present disclosure.

FIG. 7 is a flowchart illustrating a method for driving the display device according to an embodiment of the present disclosure.

Referring to FIGS. 1-7, the method for driving the display device 1 may include: detecting a logo image LI, based on image data DATA (S100); detecting a contour line CL included in a preset logo peripheral area LPA surrounding the logo image LI (S200); determining a logo upscaling area LUS and a logo downscaling area LDS by comparing the contour line CL and preset threshold values TH1 and TH2 (S320, S340, S360, and S380); and determining an upscaling area US and a downscaling area DS of the display unit 20, which correspond to a preset global shift path GS, to shift a main image MI of the display unit 20 (S400). Also, the method for driving the display device 1 may include: combining the upscaling area US, the downscaling area DS, the logo upscaling area LUS, and the logo downscaling area LDS and scaling image data corresponding to the combined scaling area (S500); and displaying an image obtained by shifting at least one selected from the logo image LI and the main image MI, based on the scaled image data SDATA (S600).

The method according to this embodiment has been described herein in more detail with reference to FIGS. 1-6B, and therefore, redundant descriptions thereof will not be repeated here.

A logo image LI may be detected based on image data DATA (S100).

A contour line CL included in a logo peripheral area LPA may be detected (S200). The logo peripheral area LPA may be a scaling area having a preset range, which surrounds the logo image LI. The contour line CL may include boundary portions at which grayscales of an image are rapidly changed.

A logo upscaling area LUS and a logo downscaling area LDS may be determined by comparing the contour line CL and preset threshold values TH1 and TH2 (S320, S340, S360, and S380).

A horizontal sum SUM1 of the contour line CL and a first threshold value TH1 may be compared (S320). In an embodiment, when the horizontal sum SUM1 of the contour line CL is smaller than the first threshold value TH1, the logo upscaling area LUS and the logo downscaling area LDS may be determined such that the logo upscaling area LUS and the logo downscaling area LDS may be respectively included in the upper logo peripheral area VLSA1 (or the lower logo peripheral area VLSA2) and the lower logo peripheral area VLSA2 (or the upper logo peripheral area VLSA1) (S360).

In an embodiment, when the horizontal sum SUM1 of the contour line CL is equal to or larger than the first threshold value TH1, the upper logo peripheral area VLSA1 and the lower logo peripheral area VLSA2 are excluded from the scaling area.

A vertical sum SUM2 of the contour line CL and a second threshold value TH2 may be compared (S340). In an embodiment, when the vertical sum SUM2 of the contour line CL is smaller than the second threshold value TH2, the logo upscaling area LUS and the logo downscaling area LDS may be determined such that the logo upscaling area LUS and the logo downscaling area LDS may be respectively included in the left logo peripheral area HLSA1 (or the right logo peripheral area HLSA2) and the right logo peripheral area HLSA2 (or the left logo peripheral area HLSA1) (S380).

In an embodiment, when the vertical sum SUM2 of the contour line CL is equal to or larger than the second threshold value TH2, the left logo peripheral area HLSA1 and the right logo peripheral area HLSA2 are excluded from the scaling area.

In some embodiments, when the horizontal sum SUM1 of the contour line CL is equal to or larger than the first threshold value TH1 and the vertical sum SUM2 of the contour line CL is equal to or larger than the second threshold value TH2, the logo upscaling area LUS and the logo downscaling area LDS are not set. The logo image LI may be shifted based on only a global shift path GS.

Separately from the setting of the logo upscaling area LUS and the logo downscaling area LDS, upscaling and downscaling areas US and DS for a global shift may be determined based on a frame count FRC (S400).

Subsequently, a net scaling target area may be calculated by combining the scaling areas determined from the steps S360, S380, and S400, and image data corresponding to the net scaling target area may be scaled (S500).

An image obtained by shifting at least one selected from the logo image LI and the main image MI, based on the scaled image data SDATA, may be displayed in the display unit 20 (S600).

As described above, in the display device and the method for driving the same according to the embodiment of the present disclosure, the entire screen (or the entire image) can be shifted without cutoff of the image at an edge of the screen and/or non-output of the image, using a complementary image scaling technique. Further, the logo peripheral area LPA is upscaled/downscaled, in addition to the global shift, so that the shift range of the logo image LI can be increased. Thus, stress of pixels, which is caused by the logo image LI, is dispersed over a larger area, and degradation of pixels and occurrence of an afterimage, which are caused by the logo image LI, can be considerably minimized or reduced.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, acts, operations, elements, and/or components, but do not preclude the presence or addition of one or more other features, integers, acts, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the terms "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

Also, any numerical range recited herein is intended to include all subranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Example embodiments have been disclosed herein, and although specific terms are employed, they are used and are to be interpreted in a generic and descriptive sense only and not for purpose of limitation. In some instances, as would be apparent to one of ordinary skill in the art at the time of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, and equivalents thereof.

What is claimed is:

1. An afterimage compensator comprising:

a global image shifter that determines an upscaling area and a downscaling area of a display unit that together correspond to a preset global shift path, and that shifts a main image of the display unit;

a logo shifter that analyzes image data corresponding to a logo image and a preset logo peripheral area surrounding the logo image, that determines a logo upscaling area and a logo downscaling area that are each included in the logo peripheral area, and that shifts the logo image; and an image scaler that combines the upscaling area, the downscaling area, the logo upscaling area, and the logo downscaling area, and that scales image data corresponding to the combined scaling area.

2. The afterimage compensator of claim 1, wherein the logo image is shifted correlatively to the shift of the main image.

3. The afterimage compensator of claim 1, wherein the main image and the logo image are shifted in different periods.

4. The afterimage compensator of claim 1, wherein the logo shifter includes:

a logo detector configured to determine the logo image and the logo peripheral area based on image data; and a scaling area determiner configured to detect a contour line included in the logo image and the logo peripheral area, and configured to determine the logo upscaling area and the logo downscaling area by comparing the contour line and a preset threshold value.

5. The afterimage compensator of claim 4, wherein the logo image is shifted in a direction from the logo upscaling area to the logo downscaling area.

6. The afterimage compensator of claim 4, wherein, when the contour line is not detected in the logo peripheral area, the scaling area determiner changes the logo upscaling area and the logo downscaling area in a preset period.

7. The afterimage compensator of claim 4, wherein the preset threshold value comprises a first threshold value, and wherein, when a horizontal sum of the contour line is smaller than the first threshold value, the logo upscaling area and the logo downscaling area are respectively included in an upper logo peripheral area of the logo image and a lower logo peripheral area of the logo image, or in the lower logo peripheral area of the logo image and the upper logo peripheral area of the logo image.

8. The afterimage compensator of claim 4, wherein the preset threshold value comprises a first threshold value and a second threshold value, and wherein, when a vertical sum of the contour line is smaller than the second threshold value, the logo upscaling area and the logo downscaling area are respectively included in a left logo peripheral area of the logo image and a right logo peripheral area of the logo image, or in the right logo peripheral area of the logo image and the left logo peripheral area of the logo image.

9. The afterimage compensator of claim 4, wherein the preset threshold value comprises a first threshold value and a second threshold value, and wherein, when the horizontal sum of the contour line is equal to or larger than the first threshold value and the vertical sum of the contour line is equal to or larger than the second threshold value, the scaling area determiner does not set the logo upscaling area and the logo downscaling area.

10. The afterimage compensator of claim 9, wherein the logo image is shifted based on the global shift path.

11. The afterimage compensator of claim 1, wherein the main image is shifted in a direction from the upscaling area to the downscaling area.

12. The afterimage compensator of claim 1, wherein a scaling ratio according to the upscaling area and the downscaling area and a scaling ratio according to the logo upscaling area and the logo downscaling area are equal to each other.

13. The afterimage compensator of claim 1, wherein the scaling ratio according to the logo upscaling area and the logo downscaling area is smaller than the scaling ratio according to the upscaling area and the downscaling area.

14. The afterimage compensator of claim 1, wherein at least one selected from a shift amount and a shift direction of a shift path of the logo image is different from that of the global shift path.

15. The afterimage compensator of claim 1, wherein the upscaling area and the downscaling area respectively correspond to preset pixel columns consecutive from an outermost pixel column of the display unit and preset pixel rows consecutive from an outermost pixel row of the display unit.

16. A method for driving a display device, the method comprising:

detecting a logo image based on image data;

detecting a contour line included in a preset logo peripheral area surrounding the logo image;

determining a logo upscaling area and a low downscaling area by comparing the contour line and a preset threshold value;

determining an upscaling area and a downscaling area of a display unit that together correspond to a preset global shift path, to shift a main image of the display unit;

combining the upscaling area, the downscaling area, the logo upscaling area, and the logo downscaling area to provide a combined scaling area, and scaling image data corresponding to the combined scaling area; and displaying an image obtained by shifting at least one selected from the logo image and the main image, based on the scaled image data.

17. The method of claim 16, wherein the preset threshold value comprises a first threshold value, and wherein, in the determining of the logo upscaling area and the logo downscaling area, when a horizontal sum of the contour line is smaller than the first threshold value, the logo upscaling area and the logo downscaling area are determined such that the logo upscaling area and the logo downscaling area are respectively included in an upper logo peripheral area of the logo image and a lower logo peripheral area of the logo image, or in the lower logo peripheral area of the logo image and the upper logo peripheral area of the logo image.

18. The method of claim 16, wherein the preset threshold value comprises a first threshold value and a second threshold value, and wherein, in the determining of the logo upscaling area and the logo downscaling area, when a vertical sum of the contour line is smaller than the second threshold value, the logo upscaling area and the logo downscaling area are determined such that the logo upscaling area and the logo downscaling area are respectively included in a left logo peripheral area of the logo image and a right logo peripheral area of the logo image, or in the right logo peripheral area of the logo image and the left logo peripheral area of the logo image.

19. The method of claim 16, wherein the preset threshold value comprises a first threshold value and a second threshold value, and wherein, in the determining of the logo upscaling area and the logo downscaling area, when the horizontal sum of the contour line is equal to or larger than the first threshold value and the vertical sum of the contour line is equal to or larger than the second threshold value, the logo upscaling area and the logo downscaling area are not set.

20. The method of claim 19, wherein the logo image is shifted based on the global shift path.

* * * * *